United States Patent [19]

Cronauer et al.

[11] 4,238,320

[45] Dec. 9, 1980

[54] DENITROGENATION OF SHALE OIL

[75] Inventors: Donald C. Cronauer, Gibsonia; Roger F. Vogel, Butler, both of Pa.; Richard A. Flinn, Littleton, Colo.

[73] Assignee: Gulf Research & Development Company, Pittsburgh, Pa.

[21] Appl. No.: 31,630

[22] Filed: Apr. 19, 1979

Related U.S. Application Data

[63] Continuation-in-part of Ser. No. 819,710, Jul. 28, 1977, abandoned.

[51] Int. Cl.[3] ..... C10G 45/08; C10G 67/06

[52] U.S. Cl. ..... 208/254 H; 208/99; 208/112

[58] Field of Search ..... 208/254 H, 254 R

[56] References Cited

U.S. PATENT DOCUMENTS

| | | | |
|---|---|---|---|
| 2,566,353 | 9/1951 | Mills | 208/254 R |
| 2,766,178 | 10/1956 | Johnstone | 208/254 R |
| 2,995,511 | 8/1961 | Herbert et al. | 208/216 R |
| 3,004,913 | 10/1961 | Tucker | 208/216 R |
| 3,019,182 | 1/1962 | Chanmugam | 208/254 R |
| 3,025,230 | 3/1962 | MacLaren | 208/254 H |
| 3,222,273 | 12/1965 | Flinn et al. | 208/254 H |

*Primary Examiner*—Delbert E. Gantz
*Assistant Examiner*—G. E. Schmitkons

[57] ABSTRACT

A process for upgrading crude shale oil containing nitrogen which comprises contacting crude shale oil in a hydrogenation zone with hydrogen in the presence of a hydrogenation catalyst to remove a selected portion of the nitrogen and then contacting the resulting product with an ion exchange resin to obtain a shale oil of substantially lower nitrogen content.

11 Claims, No Drawings

DENITROGENATION OF SHALE OIL

This application is a continuation-in-part application of our application Ser. No. 819,710 filed July 28, 1977 now abandoned entitled DENITROGENATION OF SHALE OIL.

BACKGROUND OF THE INVENTION

1. Field of Invention

Differing from crude petroleum which exists as oil in the pores of porous sands, organic matter in oil shale is believed to exist in solid form called kerogen. Crude shale oil is typically produced from oil shale by decomposition of the kerogen by heating. Crude shale oil differs from crude petroleum because, in addition to saturated and unsaturated hydrocarbons, it contains hydrocarbons, both saturated and unsaturated, in chemical and/or physical combination with a substantial amount of nitrogen, sulfur, and oxygen when compared to the elemental levels of petroleum crude. It is because of this property that crude shale oil requires additional treating when shale oil is refined by conventional petroleum refining techniques and procedures. For example, conventional refinery catalytic reforming and cracking processes can not be used to treat shale oil because of excessive carbon or coke formation and/or poisoning of active catalyst sites, which is attributable to substantial amounts of nitrogen and sulfur present in shale oil. Accordingly, an improved economical process for upgrading crude shale oil is needed to prepare a stock suitable for cracking or further refining.

2. Description of the Prior Art

"The first recorded reference to processing oil shale is in a patent issued in England in 1694 to distill 'oyle from a kind of stone.'" *Encyclopedia of Chemical Technology,* Second Edition, Volume 18, (John Wiley & Sons, Inc., 1969), p. 9. In the past, upgrading of shale oil has been performed commercially by one-stage hydrogenation or two-stage hydrogenation, such as that disclosed in U.S. Pat. No. 3,481,867 to Delbert, or by hydrogenation followed by an acid extraction process, as disclosed in U.S. Pat. No. 2,692,226 to Smith. Unfortunately, one- and/or two-stage hydrogenation processes require excessive use of hydrogen, and the two-stage hydrogenation-acid extraction process results in an acid sludge which is an industrial and environmental problem.

SUMMARY OF THE INVENTION

The present invention is directed to a process for upgrading crude shale oil containing nitrogen which comprises contacting crude shale oil in a hydrogenation zone with hydrogen in the presence of a hydrogenation catalyst to remove a selected portion of the nitrogen and then contacting the resulting product with an ion exchange resin to obtain a shale oil of substantially lower nitrogen content.

BRIEF DESCRIPTION OF THE INVENTION

The present invention comprises a two-stage process for upgrading crude shale oil. In the first stage the crude shale oil is catalytically hydrogenated to obtain an intermediate product. The intermediate product is then placed in contact with an ion exchange resin in the second stage to produce a low-nitrogen liquid fuel suitable for cracking or further refining.

Composition of Crude Shale Oil

In general, the approximate elemental composition of crude shale oil, on a moisture-free, solid-free basis, can be as follows:

TABLE 1

| | Elemental Composition Weight Per Cent | |
|---|---|---|
| | Broad Range | Preferred Range |
| Carbon | 70–95 | 78–92 |
| Hydrogen | 4.5–15 | 5–13 |
| Nitrogen | 0.1–4 | 0.1–3 |
| Oxygen | 0.1–4 | 0.1–2.5 |
| Sulfur | 0.1–7 | 0.1–3.5 |

The nitrogen content of crude shale oils often is twice as high as that in petroleum and therefore will require special refining methods. To meet environmental standards, these fuels must undergo denitrogenation. Nitrogen compounds in crude shale oil are classified as basic and nonbasic, based upon the ability of a nitrogen compound to interact with a perchloric acid-acetic acid solution. Examples of basic nitrogen compounds include pyridines, quinolines, amines, indolines, and hexahydrocarbazoles. Examples of non-basic nitrogen compounds include pyroles, indoles, and carbazoles. In the present invention we have found, surprisingly, that the ratio of basic nitrogen compounds to total nitrogen compounds increases during the hydrogenation stage and that the basic nitrogen compounds in the intermediate product are the nitrogen compounds removed from the intermediate product during the ion exchange stage. The nitrogen compounds remaining in the final product are believed to be the unconverted, non-basic type.

Further, the composition of the hydrocarbons based upon the level of saturation in crude shale oil can be as follows:

TABLE 2

| | Level of Saturation of Shale Oil Weight Per Cent | |
|---|---|---|
| | Broad Range | Preferred Range |
| Saturated hydrocarbons | 1 to 40 | 5 to 20 |
| Unsaturated hydrocarbons | 60 to 99 | 80 to 95 |

Also, the crude shale oil can be further defined by boiling point fractions as follows:

TABLE 3

| | Composition by Boiling Point Fractions | | |
|---|---|---|---|
| | Nominal Boiling | Weight Per Cent | |
| Fraction | Range, °C. | Broad Range | Preferred Range |
| Naphtha | below 190.5 | 2 to 20 | 3 to 15 |
| Light distillate | 190.5–360 | 15 to 32 | 20 to 30 |
| Heavy distillate | 360–516 | 20 to 38 | 25 to 35 |
| Residuum | above 516 | 10 to 26 | 18 to 25 |

Examples of crude shale oils which can be used in the present invention include naphtha, light distillates, heavy distillates, etc.

First Stage of the Process

The crude shale oil is passed into a hydrogenation zone wherein olefins present are hydrogenated, a selected portion of the nitrogen is removed therefrom and an increase is obtained in the ratio of basic nitrogen compounds to total nitrogen compounds compared to the ratio of basic nitrogen compounds to total nitrogen compounds in the crude shale oil.

Catalysts found most suitable for use in the first stage of the hydrogenation process of the present invention can be any conventional hydrogenation catalysts known in the art such as NiW, CoMo, NiCoMo, NiMo, NiWF, NiTiMo, or, generally speaking, combinations of Group VI and Group VIII metals. The catalytically active metals can be employed in undiluted form, but preferably they are supported on an absorbent carrier in proportions ranging from about three to about 50 percent by weight, preferably from about five to about 40 percent by weight, based on the weight of the catalyst. Suitable carriers include, in general, the inorganic refractory oxides, e.g., alumina, silica, zirconia, titania, zeolites, and clays. The preferred carrier is activated alumina. A suitable catalyst is a nickel-tungsten on activated alumina.

The first-stage hydrogenation process of the present invention can be conducted under the following conditions:

TABLE 4

First-Stage Reaction Conditions

| | Broad Range | Preferred Range |
|---|---|---|
| Temperature, °C. | 330 to 415 | 340 to 400 |
| Pressure, Psig (MPa) | 500 to 2500 (3.45 to 17.3) | 700 to 2000 (4.82 to 13.8) |
| Liquid Hourly Space Velocity (Volume of Oil/ Volume of Catalyst Per Hour at [STP]) | 0.5 to 4.0 | 0.75 to 3.0 |
| | 1,000 to 15,000 | 2,000 to 12,000 |
| Hydrogen Flow, SCF of $H_2$per Barrel of Liquid Feed ($m^3H_2/m^3$ oil) | (178 to 2,670) | (356 to 2,140) |

The hydrogenation of the crude feed shale oil is continued until the treated, or intermediate, oil contains from about 35 to about 95 weight percent, preferably from about 40 to about 90 weight percent of the nitrogen present in the original feed stock. The percent increase in the ratio of basic nitrogen to total nitrogen in the treated oil after hydrogenation compared to the ratio of basic nitrogen to total nitrogen in the crude feed shale oil will range from about 15 to 40 percent, generally from about 20 to 40 percent. The hydrogenation, or intermediate, product so obtained will contain from about 0.05 to about 4.0 weight percent nitrogen, generally from about 0.2 to about 3.0 weight percent nitrogen.

Second Stage of the Process

The second stage of the process of the present invention is an ion exchange treatment to further reduce the nitrogen content of the shale oil obtained at the end of the first stage.

Typically, the intermediate product obtained from the first stage is passed through a column packed with an ion exchange resin. Since the ion exchange treatment is an exothermic process, for safety, the column is preferably made of a metal or metal alloy such as stainless steel; however, other columns of other materials can be used if means are employed for control of the heat released by the reaction.

The ion exchange resin used in the column can be of the cationic type which must be effective in a nonpolar media such as hydrocarbons. It is preferred that a resin classified as "macroreticular" be used. Specifically, these resin particles have a high degree of internal porosity, thereby having large surface areas and numerous sites to retain nitrogen-containing basic compounds. British Pat. Nos. 932,125 and 932,126 contain a description and preparation of resins of this type. Such a resin would have internal porosity of between about 0.05 and about 0.60 ml pore/ml bead, preferably between about 0.20 and about 0.55 ml pore/ml bead; a surface area of about 10 to about 600 $m^2$/gm, preferably about 20 to about 500 $m^2$/gm; and an average pore diameter of about 100 to about 1000 Å, preferably about 150 to about 750 Å. A suitable ion exchange resin and the one which was used in the experiments of this invention herein was obtained from Rohm and Haas Company and designated as Amberlyst 15. Other suitable ion exchange resins include: Amberlite XE-284 and Amberlite 120 which may be obtained from Rohm and Haas Company and 50 W-X8 Macroreticular Resin from Bio-Rad, Richmond, Calif.

The intermediate product is passed through a column, preferably vertical, filled with the defined resin at a space velocity (volume of oil/volume of resin/hour) at STP of about 0.05 to about 20, preferably about 0.1 to about 10, at a temperature of about 0° to about 120° C., preferably about 10° to about 80° C. The primary limitation on temperature is that of having the oil at a high enough temperature to ensure that the oil is of low viscosity for adequate transport rates and yet not exceed the limit of thermal stability of the resin, which is typically about 120° C. The column is preferably operated at atmospheric, or ambient, pressure or with sufficient liquid head to result in adequate liquid flow through the resin bed. Higher pressures, for example, up to about 100 pounds per square inch gauge (about 0.7 MPa), or even higher, can be employed, but offer no apparent advantage. The amount of resin employed to the volume of intermediate product is not critical; the only requirement is that there be sufficient resin to exchange the nitrogen in the intermediate product. The intermediate product is passed through the column until a desired "break point" of basic nitrogen compounds is observed. Break point is defined in the *Chemical Engineer's Handbook,* R. H. Perry, editor (McGraw-Hill, New York, N.Y., 1966), Chapter 16, pages 16 to 18. To meet this requirement, usually from about one to about 50 volumes of intermediate product per volume of resin and preferably about two to about 20 volumes of intermediate product per volume of resin can be effectively treated.

The resin in the packed column can be regenerated, if desired, using the following procedure. The resin is first flushed with a solvent, such as methanol. The product from solvent flushing is distilled to recover shale oil and solvent, which may be recycled. The packed column is then treated with a stream that contains methanol, totally or partially saturated with ammonia (i.e., saturation being carried out at about 0° to 30° C. with heat being generated upon dissolution of ammonia; therefore, lower temperatures are preferred). The ammonia/methanol regeneration treatment is continued until the product effluent becomes basic pH>8.0). Various amines such as methyl, ethyl and propyl can be used instead of ammonia, but their recovery for further use hinders their applicability. The packed column is subsequently treated with a dilute HCl or $H_2SO_4$ solution in methanol to protonate the resin bed. This treatment is continued until the effluent stream from the bed is acidic. The packed bed is then flushed with a solvent such as methanol and is blown with inert gas to remove the solvent. The bed is then ready for the next cycle.

The low-nitrogen liquid fuel obtained at the end of the second stage contains from about 0.01 to about one percent by weight, preferably about 0.05 to about 0.4 percent by weight of nitrogen, which is believed to be primarily of the non-basic type.

DESCRIPTION OF THE PREFERRED EMBODIMENTS

The present invention will be further described by the following experimental data in Examples I to IV.

The catalyst used in the hydrogenation zone was purchased under the tradename Ni-4303 from Harshaw Chemical Company. The ion exchange resin used was purchased under the tradename Amberlyst 15 from Rohm and Haas Company. Calculated on a dry basis (less than one percent moisture), Amberlyst 15 has a surface area of from 40 to 50 $m^2/gm$, porosity of 0.30 to 0.35 ml pore/ml bead, and an average pore diameter of 200 to 600 Å.

A Colorado shale oil was distilled to obtain a furnace oil fraction boiling between 214° and 338° C. The following analytical inspections were obtained:

| | |
|---|---|
| Gravity, ° API | 29.3 |
| Sulfur, Weight Percent | 0.77 |
| Total Nitrogen, Weight Percent | 1.63 |
| Basic Nitrogen, Weight Percent | 1.06 |
| Ratio of Basic to Total Nitrogen | 0.65 |
| Oxygen, Weight Percent | 1.20 |
| Carbon, Weight Percent | 84.53 |
| Hydrogen, Weight Percent | 12.09 |
| Arsenic, PPM | <1.0 |

Total Nitrogen Analysis

A macro-Kjeldahl method was used for the total nitrogen determinations in the experimental data. Twenty grams of potassium sulfate, 1.3 grams of mercury, and 20 milliliters of sulfuric acid (specific gravity 1.84) were added to a Kjeldahl flask. A one-gram sample was added to the mixture and the neck of the flask was washed with 15 milliliters of sulfuric acid (specific gravity 1.84). The contents of the flask were mixed by swirling, and one or two glass beads were added to the contents of the flask. The flask was placed on a digestion rack and heated over a low heat (25° to 75° C.) until frothing ceased. During the frothing period, the flask was rotated frequently to allow uniform charring of the sample. Intermediate heat (50° to 100° C.) was applied for 10 minutes; then the contents of the flask were brought to a rapid boil which was continued for one hour. The heat was turned off and the flask was left to sit until fumes subsided. The flask was cooled by immersing the bulb in tap water. One hundred milliliters of deionized water were added to the flask contents to dissolve the salt cake. The flask was warmed over a low flame during the water addition, if necessary. Three hundred milliliters of deionized water were added to the flask contents which were then cooled to ambient temperature. Two or three pieces of mossy zinc (Fisher Z-11) were added to the flask. With the flask held at about a 45° angle, 100 milliliters of a sodium hydroxide-sodium sulfide solution prepared by dissolving 1200 grams of flake sodium hydroxide and 900 grams of sodium sulfide nonahydrate in 2700 milliliters of deionized water were added slowly to the flask contents so that the solution formed a layer on the bottom of the flask. The flask was connected to a distillation condenser through a spray trap and swirled. The condenser was equipped with a 500-milliliter Erlenmeyer receiver flask containing 25 milliliters of saturated boric acid solution and 5 drops of methyl purple indicator. The flask was heated over a high heat (90° to 140° C.). When the liquid in the receiver flask reached about 130 milliliters, the receiver was lowered to expose the condenser tip which was rinsed with deionized water. After one minute of additional distillation, the heat was turned-off to allow the condenser to drain; however, the total volume did not exceed 150 milliliters. If necessary, deionized water was added to bring the total volume to 150 milliliters. Five drops of methyl purple indicator was added to the distillate, and the solution was titrated with 0.1 N sulfuric acid until the green color faded through gray to a purple color. Duplicate blanks were performed using 8.0 grams of isooctane for the sample. Total nitrogen content was calculated by the following equation:

$$\text{Nitrogen, weight per cent} = \frac{1.401(A - B)(N)}{W}$$

where

A = volume of standard sulfuric acid required to titrate the sample in milliliters;

B = volume of standard sulfuric acid required to titrate the blank;

N = normality of standard sulfuric acid; and

W = weight of the sample in grams.

Basic Nitrogen Analysis

The following procedure was employed for the determination of basic nitrogen compounds. Five grams of sample was dissolved in 125 cc. of acetic acid. A burette was filled with 0.05 N perchloric acid. The electrodes of a Beckman Model K automatic titrator were placed in the beaker containing the dissolved sample. The instrument set on the "mv" scale, the anticipator control on "3" and the indicator dial on +570 mv, and the sample was titrated. A standard basic nitrogen solution was prepared by dissolving 32 grams of pyridine into glacial acetic acid until the volume amounted to 200 milliliters. The basic nitrogen content, in micrograms per milliliter, in this solution was calculated by multiplying the weight of pyridine in grams by 886. Five milliliters of the standard solution was titrated to +570 mv to determine the perchloric acid factor from the equation $$F = 5(f)/A,$$

wherein F is the perchloric acid factor, in micrograms of basic nitrogen per milliliter, f is the standard pyridine solution factor from solution preparation and A is the volume of perchloric acid required in milliliters. After the standard and the unknown have been titrated the basic nitrogen content of the sample, in ppm, was calculated as follows:

$$FA/W,$$

wherein F and A are as above and W is the weight of the sample in grams.

Example I: Hydrogenation Alone

The furnace oil cut of shale oil defined above was passed to a hydrogenation zone over a six weight percent nickel, 19 weight percent tungsten supported on alumina catalyst at a temperature of 377° C., a pressure of 1750 psig (12.0 MPa), a space velocity (S.V.) of 1.0 (volume of oil per volume of catalyst per hour) together with 5000 SCF $H_2$/bbl (890 $m^3H_2/m^3$ oil). The product so obtained took up 126 $m^3H_2/m^3$ oil, had a total nitrogen content of 0.27 weight percent, and 98.03 percent by weight of the oil was recovered.

Example II: Hydrogenation Followed by Ion Exchange

A furnace oil cut of shale oil having the same characteristics given in Example I was passed through a hydrogenation zone over a six weight percent nickel, 19 weight percent tungsten supported on alumina catalyst at a temperature of 377° C., a pressure of 1,000 psig (6.9 MPa), a space velocity of 1.0 (volume of oil per volume of catalyst per hour) together with 5000 SCF $H_2$/bbl (890 $m^3H_2/m^3$ oil).

The intermediate product obtained as a result of the hydrogenation took up 89 $m^3H_2/m^3$ oil and had a total nitrogen content of 0.82 weight percent and a basic nitrogen content of 0.70.

The intermediate product was passed through an ion exchange treatment zone comprising a 30-inch by ⅜-inch inside diameter column containing 30 grams of an ion exchange resin known as Amberlyst 15 at an average space velocity (volume of oil per volume of resin per hour) of 0.46 for seven hours. At break point the product contained 0.12 weight percent total nitrogen.

The resin was flushed with pentane (20 volumes per volume of resin) and then treated with a solution of ammonia saturated at 0° C. in methanol until a basic effluent solution was observed by use of litmus paper. The ammonia/methanol effluent was stripped from the column by evaporation to recover 5.6 weight percent of the shale oil from the column. Total oil recovered was 98.86 weight percent.

Example III: Hydrogenation Alone

A furnace oil cut of shale oil having the same characteristics given in Example I was passed through a hydrogenation zone over a six weight percent nickel, 19 weight percent tungsten supported on alumina catalyst at a temperature of 385° C., a pressure of 1769 psig (12.2 MPa), and a space velocity of 1.0 (volume of oil per volume catalyst per hour), together with 5000 SCF $H_2$/bbl (890 $m^3H_2/m^3$ oil).

The product so obtained took up 169 $m^3$ $H_2/m^3$ oil, had a total nitrogen content of 0.17 weight percent, and 90.94 percent by weight of the oil was recovered.

Example IV: Hydrogenation Followed by Ion Exchange

A furnace oil cut of shale oil having the same characteristics given in Example I was passed through a hydrogenation zone over a 6 weight percent nickel, 19 weight percent tungsten supported on alumina catalyst at a temperature of 675° F. (357° C.), a pressure of 1755 psig (12.1 MPa), and a space velocity of 1.0 (volume of oil per volume catalyst per hour), together with 5000 SCF $H_2$/bbl (890 $m^3H_2/m^3$ oil).

The intermediate product obtained as a result of hydrogenation took up 95 $m^3H_2/m^3$ oil and had a total nitrogen content of 0.72 weight percent and a basic nitrogen content of 0.60 weight percent.

The intermediate product was passed through an ion exchange treatment zone comprising a 40-inch by ¼-inch inside diameter column containing 15.8 grams of an ion exchange resin known as Amberlyst 15 at an average space velocity of 2.0 for 2.8 hours. At break point the product contained 0.12 weight percent total nitrogen.

The resin was flushed as in Example 2 and an additional 3.1 weight percent of shale oil was recovered. Total oil recovered was 99.01 weight percent.

The data obtained as a result of the above runs are summarized below in Table V.

TABLE V

EXPERIMENTAL DATA

Analysis of Hydrogenated Product

| Example | $H_2$ Uptake $m^3H_2/m^3$ Oil | Total $N_2$ Content, Weight Per-Cent | Total Basic $N_2$ Content, Weight Per-Cent | Ratio of Basic $N_2$ to Total $N_2$ | Percent Increase In Ratio of Basic to Total Nitrogen Compared to Charge | Ion Ex-change Resin | Actual $N_2$ Content at Break Point In Final Product, Weight Per-Cent | Weight Percent $N_2$ In Final Product At Break Point Predicted if No Shift of Non-Basic $N_2$ to Basic $N_2$ Had Occurred | Percent Improvement In $N_2$ Content Over Predicted $N_2$ Content In Final Product |
|---|---|---|---|---|---|---|---|---|---|
| I | 126 | 0.27 | — | — | — | — | — | — | — |
| II | 89 | 0.82 | 0.72 | 0.85 | 31 | Amberlyst 15 | 0.12 | 0.29 | 59 |
| III | 169 | 0.17 | — | — | — | — | — | — | — |
| IV | 95 | 0.72 | 0.60 | 0.83 | 28 | Amberlyst 15 | 0.12 | 0.25 | 52 |

The data in Table V are most unusual. Examples I and III show that the level of nitrogen in shale oil can be reduced significantly solely by hydrogenation. However, the hydrogen consumption is high, amounting to 126 $m^3H_2/m^3$ oil and 169 $m^3H_2/m^3$ oil, respectively. Examples II and IV show that by removing only a selected amount of nitrogen by hydrogenation in a first step, followed by a simple ion-exchange treatment, the hydrogen consumption is reduced significantly, only 89 $m^3H_2/m^3$ oil and 95 $m^3H_2/m^3$ oil, respectively, with a similarly low nitrogen content in the final product.

The data also show that if we subject the charge to partial hydrogenation, whereby only a selected amount of the nitrogen compounds are removed therefrom, a significant improvement is obtained in the ratio of basic nitrogen compounds to total nitrogen compounds. Had there been no such shift in conversion of non-basic nitrogen compounds to basic nitrogen compounds, treatment of the hydrogenated product with an ion-exchange resin would not have resulted in the removal of non-basic nitrogen compounds therefrom and the final product would have attained a higher nitrogen level than desired. But because of such shift during selected hydrogenation, as defined herein, the ion-exchange resin is able to remove from the hydrogenation product not only the basic nitrogen compounds originally present in the charge but also the basic nitrogen compounds produced during hydrogenation. This is a significant improvement, because more of the nitrogen compounds in the crude shale oil can be removed by use of an ion-exchange resin than would have been predicted.

That conversion of non-basic nitrogen compounds to basic nitrogen compounds occurs during hydrogenation as defined herein is seen from the following.

EXAMPLE V

A support weighing 95.46 grams, prepared by sizing 150 cc. of Harshaw A1-1705 alumina to 14–30 mesh, was impregnated with 141 cc of a solution of nickel nitrate and ammonium tungstate containing 41.49 grams of $Ni(NO_3)_2.6H_2O$ and 36.15 grams of ammonium meta tungstate and then dried at 120° C. under nitrogen. Fifty cubic centimeters of this catalyst was calcined at 538° C. under a flow of ammonia. The finished catalyst contained by weight six percent nickel and 19 percent tungsten. A furnace oil cut of shale oil having the following characteristics:

| | |
|---|---|
| Gravity, °API | 29.3 |
| Sulfur, Weight Percent | 0.75 |
| Total Nitrogen, Weight Percent | 1.63 |
| Basic Nitrogen, Weight Percent | 1.02 |
| Ratio of Basic to Total Nitrogen | 0.62 |
| Oxygen, Weight Percent | 1.15 |

was passed through a hydrogenation zone over the catalyst prepared above at a temperature of 388° C., a pressure of 1500 psi (10.3 MPa) and a space velocity of 1.5 LHSV, together with 10,000 SCF $H_2$/bbl (1780 $m^3H_2/m^3$ oil). The product after an 84-hour on-stream period was found to contain 1.51 weight percent total nitrogen and 1.16 weight percent basic nitrogen. Thus there was an increase in basic nitrogen content from 1.02 weight percent in the charge to 1.16 weight percent in the hydrogenated oil.

Obviously, many modifications and variations of the invention, as hereinabove set forth, can be made without departing from the spirit and scope thereof and, therefore, only such limitations should be imposed as are indicated in the appended claims.

We claim:

1. A process for upgrading crude shale oil containing basic and nonbasic nitrogen compounds which comprises contacting said crude shale oil containing from about 0.1 to about 4 weight percent nitrogen in a hydrogenation zone at a space velocity of about 0.5 to about 4.0 v/v/hr., a pressure of about 500 to about 2500 psig and a temperature of about 330° to about 415° C. with hydrogen in the presence of a nickel-tungsten hydrogenation catalyst supported on activated alumina to obtain a treated oil containing from about 35 to about 95 weight percent of the nitrogen present in the feed and thereby increasing the ratio of basic nitrogen compounds to total nitrogen compounds by about 15 to about 40 percent and then contacting the resulting hydrogenation product with an ion-exchange resin to obtain shale oil containing from about 0.01 to about one weight percent nitrogen.

2. The process of claim 1 wherein the hydrogenated oil contains from about 40 to about 90 percent of the nitrogen present in the feed.

3. The process of claim 1 wherein said crude shale oil has a nitrogen content of about 0.1 to about 3 weight percent and is contacted in said hydrogenation zone with hydrogen at a space velocity of about 0.75 to about 3.0 v/v/hr., a pressure of about 700 to about 2000 psig, and a temperature of about 340° to about 400° C.

4. The process of claim 1 wherein said catalyst is six weight percent nickel, 19 weight percent tungsten supported on activated alumina.

5. The process of claim 1 wherein said catalyst is supported on a carrier in proportions ranging from about 3 to about 50 percent by weight based on the weight of the catalyst.

6. The process of claim 1 wherein said ion exchange resin is of the cationic type, which is classified as macroreticular having an internal porosity of between about 0.05 and about 0.60 ml pore/ml bead and a surface area of about 10 to about 600 $m^2$/gm.

7. The process of claim 6 wherein said internal porosity is between about 0.20 and about 0.55 ml pore/ml bead, and said surface area is about 20 to about 500 $m^2$/gm.

8. The process of claim 6 wherein said internal porosity is between about 0.30 to about 0.35 ml pore/ml bead, said surface area from about 40 to about 50 $m^2$/gm, and the average pore diameter is in the range of about 200 to about 600 Å.

9. The process of claim 1 wherein the hydrogenated product is passed over said resin at a space velocity at STP of about 0.05 to about 20, at a temperature of about 0° to about 120° C.

10. The process of claim 9 wherein said space velocity is about 0.1 to about 10 and said temperature is about 10° to about 80° C.

11. The process of claim 1 wherein said crude shale oil contains from about 0.1 to about 3 weight percent nitrogen, the hydrogenated oil contains from about 40 to about 90 weight percent of the nitrogen present in the feed, with an increase in the ratio of basic nitrogen compounds to total nitrogen compounds of about 20 to 40 percent, and wherein the shale oil at the end of the process contains from about 0.05 to about 0.4 weight percent nitrogen.

* * * * *